US006644483B1

(12) United States Patent
-Lai

(10) Patent No.: US 6,644,483 B1
(45) Date of Patent: Nov. 11, 2003

(54) HANGER DISPLAY ASSEMBLY

(75) Inventor: Ming-Te -Lai, Shintien (TW)

(73) Assignee: EK Success, Ltd., Clifton, NJ (US)

( * ) Notice: Subject to any disclaimer, the term of this patent is extended or adjusted under 35 U.S.C. 154(b) by 0 days.

(21) Appl. No.: 10/155,250

(22) Filed: May 24, 2002

(51) Int. Cl.[7] ..... A47F 5/00

(52) U.S. Cl. ..... 211/87.01; 211/94.01; 211/57.1; 248/222.52

(58) Field of Search ..... 211/57.1, 59.1, 211/94.01, 87.01; 248/222.52, 222.51, 225.11

(56) References Cited

U.S. PATENT DOCUMENTS

| | | | | | |
|---|---|---|---|---|---|
| 3,443,783 | A | * | 5/1969 | Fisher | |
| 3,894,707 | A | * | 7/1975 | Heard | |
| 4,467,987 | A | * | 8/1984 | Small | |
| 4,598,504 | A | * | 7/1986 | Itagaki | 211/87.01 X |
| 4,635,801 | A | * | 1/1987 | Oren | 211/94.01 X |
| 4,805,784 | A | * | 2/1989 | Solheim et al. | 211/94.01 |
| 4,826,022 | A | * | 5/1989 | Duarte | 211/94.01 |
| 4,846,354 | A | * | 7/1989 | Adams | 211/94.01 X |
| RE33,596 | E | * | 5/1991 | Ennis | 248/225.11 |

* cited by examiner

*Primary Examiner*—Robert W. Gibson, Jr.
(74) *Attorney, Agent, or Firm*—Sofer & Haroun, LLP

(57) ABSTRACT

The present invention is directed to a display assembly comprised of a display panel having an elongated substantially horizontal extending slot, where the display panel has a front side and a rear side. A hanger display assembly is provided having a base portion, where the base portion has a first and second side and an engagement portion connected to the first side of the base portion, where the engagement portion includes first and second diverging arms protruding substantially perpendicular to the first side of the base portion. A hanger element is provided which extends outwardly from the second side of the base portion, where the hanger element is substantially perpendicular to the base potion. The arms are receivable through the slot when they are substantially aligned therewith, but not when they are disposed in a substantially transverse relation to the slot. The arms are receivable for engagement with the rear side of the display panel when positioned substantially transverse to the slot so that the first side of the base portion directly abuts the front side of the display panel so that the hanger element extends outwardly beyond the front side of the display panel for receiving and supporting an item in front of the display panel.

17 Claims, 3 Drawing Sheets

HANGER DISPLAY ASSEMBLY

FIELD OF THE INVENTION

The present invention is directed to a merchandise display device. More specifically, the present invention is directed to a hanger display assembly for displaying merchandise.

BACKGROUND OF THE INVENTION

A variety of different types of display apparatuses are available for displaying merchandise. Pegboard assemblies comprising panels and hanger elements which are mounted in the panels have been widely used for supporting articles in various displays. However, the hanger elements of these assemblies are prone to becoming inadvertently disengaged from the panels, and, for practical reasons, pegboard type display assemblies have often been found to be unsatisfactory. Other types of display assemblies which include panels having permanently mounted hanger elements have also been found to be less than satisfactory because they cannot be readily adapted to meet the needs of various merchandise display arrangement.

Other display apparatuses provide a hanger element securable to a display panel having an engagement portion which includes arms and a hanger portion which extends outwardly from the arms. The arms are formed so that they are receivable through a slot where the arms are adapted so that they are receivable in engagement in the notches defined by upper and lower positioning means for retaining the engagement portion in a position where the arms are in substantially transverse relation to the slot adjacent the rear side of the front plate. When the hanger element is positioned, the hanger portion extends outwardly beyond the front plate for receiving and supporting an item for display in front of the front plate.

However, the methods and apparatuses disclosed in the prior art for using such hanger assemblies in the prior art suffer from several drawbacks including durability problems caused when the clips are rotated and locked into position. Also, clips from the prior art require a special form of slatboard to receive the hanger attachment portions, thus greatly reducing the compatibility with existing slatboard display panels and increasing the manufacturing costs related to production of the specialized slatboard.

Therefore, it is an object of the present invention to overcome the drawbacks associated with the prior art and provide a hanger display assembly for use in slatboard or the like, which is of a durable easy to use construction, that allows for both inexpensive durable construction as well as ease of use when configuring merchandise displays. Another object of the present invention is to provide such a hanger display assembly that is capable of being used on a standard slatboard or similar display panel without require a specialized arrangement for connecting and securing the hanger assembly.

SUMMARY OF THE INVENTION

The present invention is directed to a display assembly comprised of a display panel having an elongated substantially horizontal extending slot, where the display panel has a front side and a rear side. A hanger display assembly is provided having a base portion, where the base portion has a first and second side and an engagement portion connected to the first side of the base portion, where the engagement portion includes first and second diverging arms protruding substantially perpendicular to the first side of the base portion. A hanger element is provided which extends outwardly from the second side of the base portion, where the hanger element is substantially perpendicular to the base potion. The arms are receivable through the slot when they are substantially aligned therewith, but not when they are disposed in a substantially transverse relation to the slot. The arms are receivable for engagement with the rear side of the display panel when positioned substantially transverse to the slot so that the first side of the base portion directly abuts the front side of the display panel so that the hanger element extends outwardly beyond the front side of the display panel for receiving and supporting an item in front of the display panel.

DETAILED DESCRIPTION OF THE PREFERRED EMBODIMENTS

Figure 1:
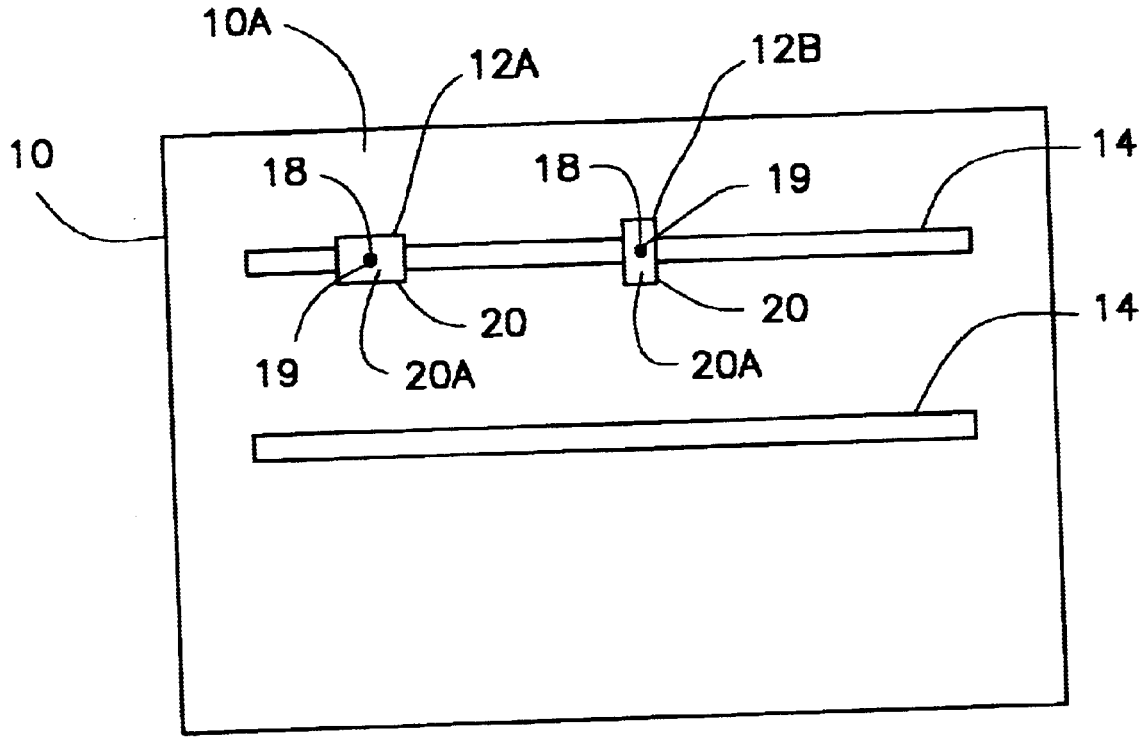
FIG. 1 is a front view of a hanger display assembly showing a display assembly and display panel in accordance with one embodiment of the present invention.
Figure 2:
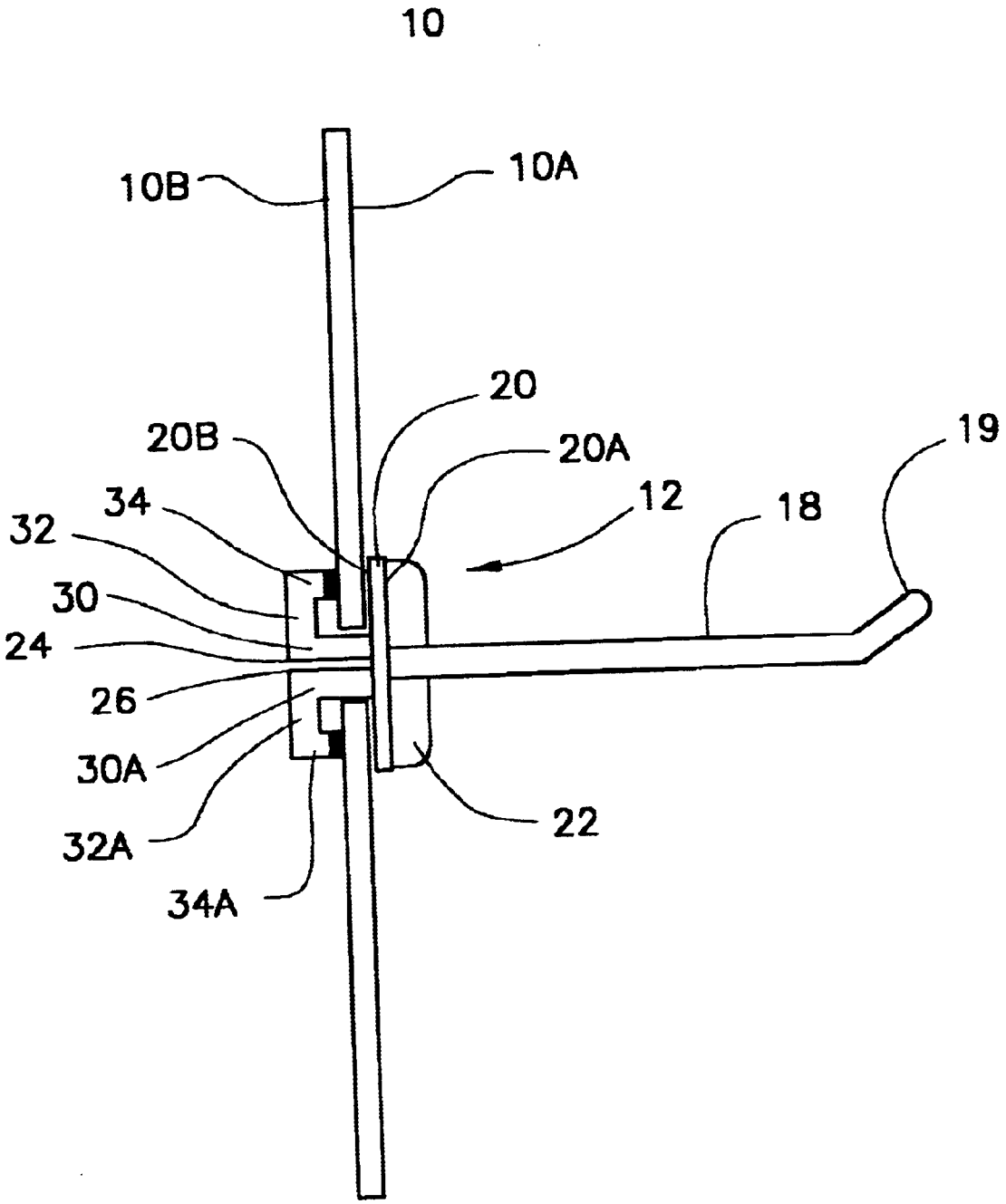
FIG. 2 is a cutaway side view of a hanger display assembly showing the display assembly and the display panel from FIG. 1, in accordance with one embodiment of the present invention.

In one embodiment of the present invention and with reference to FIGS. 1 and 2, a display panel 10 is provided for supporting a hanger display assembly 12. In one embodiment of the present invention, display panel 10 is a basic slatboard having a substantially horizontal slot 14 disposed thereon, however, this is no way intended to limit the scope of the present invention. Any display panel 10 maintaining a similar slot 14 in a substantially horizontal direction is within the contemplation of the present invention.

Hanger display assembly 12 is configured to be mounted in slot 14 of display panel 10. Hanger display assembly 12 is positioned along slot 14 while being held in parallel to the direction of slot 14, depicted as assembly 12*a* in FIG. 1. When hanger display assembly 12 is in the desired position for displaying merchandise, hanger display assembly 12 is rotated approximately 90 degrees in slot 14 to a direction transverse to slot 14, locking hanger display assembly 12 in place, depicted as assembly 12*b* in FIG. 1.

In one embodiment of the present invention, as illustrated in FIG. 2, hanger display assembly 12 is depicted in the locked display formation in display panel 10. Hanger display assembly 12 is comprised of a hanger element 18, a base plate 20, a hanger element support 22, upper arm 24 and lower arm 26. Hanger display assembly 12, and all of its component parts, is preferably constructed of a molded polyurethane plastic, however, this is in no way intended to limit the scope of the present invention. For example, hanger display assembly 12 may be constructed of metal or fiberglass. Any material used for the construction of hanger display assembly 12 which is of durable construction and capable of supporting the necessary amount of merchandise weigh is within the contemplation of the present invention.

In one embodiment of the present invention, as illustrated in FIG. 2, hanger element 18 extends perpendicularly away from the center of base plate 20. Hanger element 18 may extend for any distance so long as it is of sufficient strength to support the weight of the displayed merchandise. Longer hanger elements 18 may be used for displaying larger amounts of light merchandise and shorter hanger elements 18 may be used to display heavier merchandise. In one embodiment of the present invention, hanger element 18 maintains a raised portion 19 at the end distal from base plate 20 so as to prevent merchandise displayed thereon from sliding off the end of hanger element 18.

In another embodiment of the present invention as, as illustrated in FIG. 2, a single hanger element 18 extends outwardly from the center the front side 20*a* of base plate 20, however this is in no way intended to limit the scope of the present invention. For example, a single base plate 20 could maintain multiple hanger elements 18 if so desired, or the single hanger element 18 may be positioned in different locations other than the center of base plate 20 so as to better balance the weight of the merchandise from base plate 20 against a front side 10*a* of display panel 10. Hanger element support 22 extends outwardly away from base plate 20 and attaches to hanger element 18 along a portion of hanger element 18 immediately adjacent to base plate 20. Hanger element support 22 adds additional support to hanger element 18 so as to prevent heavy merchandise or accidental customer bumping to break hanger element 18 from base plate 20.

In one embodiment of the present invention, hanger element 18 preferably extends from front side 20*a* of base plate 20 for 2.75", and raised portion 19 preferably comprises 0.25" of the length of hanger element 18. Base plate 20 preferably extends perpendicular to hanger element 18 for 1.25" in the vertical direction and 0.75" in the horizontal direction. However, it should be noted that these sizes are intended for illustration purposes only and in no way are intended to limit the scope of the present invention. Any hanger display assembly having similar components, regardless of the dimensions of the elements is within the contemplation of the present invention.

In one embodiment of the present invention, as illustrated in FIG. 2, upper arm 24 and lower arm 26 extend away from the rear side 20*b* of base plate 20 in the opposite direction of hanger element 18 and are configured to support hanger display assembly 12 in slot 14 of display panel 12. Arms 24 and 26, base plate 20, hanger element 18 and hanger support element 22 are preferably all of a unitary construction so as to provide durability to hanger display assembly 12.

In one embodiment of the present invention, first and second arms 24 and 26 preferably extend 0.5" away from back side 20*b* of base plate 20. Additionally, first and second diverging arms 24 and 26 are preferably formed separately from one another so that they are capable of independent movement. However, this configuration is intended only as an example and is in no way intended to limit the scope of the present invention. Any similar hanger display assembly maintaining similar elements and proportions is within the contemplation of the present invention.

In one embodiment of the present invention, as illustrated in FIG. 2, upper arm 24 is comprised of an upper extension portion 30, and upper rising portion 32 and a upper clip portion 34. Upper extension portion 30 extends perpendicularly away from rear side 20*b* of base plate 20 in the opposite direction of hanger element 18. At the end of upper extension portion 30, distal to base plate 20, upper rising potion 32 extends perpendicularly away from to upper extension portion 30, parallel to base plate 20, upward in the same direction as rising portion 19 of hanger element 20. At the end of upper rising portion 32, distal to upper extension portion 30, upper clip portion 34 extends perpendicularly away from upper rising portion 32, perpendicular to base plate 20, facing inward in the same direction as hanger element 20.

In one embodiment of the present invention, as illustrated in FIG. 2, lower arm 26 is comprised of a lower extension portion 30*a*, a lower descending portion 32*a* and a lower clip portion 34*a*. Lower extension portion 30*a* extends perpendicularly away from the rear side 20*b* of base plate 20 in the opposite direction of hanger element 18. At the end of lower extension portion 30*a*, distal to base plate 20, lower descending potion 32*a* extends perpendicularly away from lower extension portion 30*a*, parallel to base plate 20, downwardly in the opposite direction as rising portion 19 of hanger element 20. At the end of lower descending portion 32*a*, distal to lower extension portion 30*a*, lower clip portion 34*a* extends perpendicularly away from lower descending portion 32*a*, perpendicular to base plate 20, facing inward in the same direction as hanger element 20.

Upper and lower clip portions 30 and 30*a* of upper arm 24 and lower arm 26 are used to support hanger display assembly 12 in slot 14 of display panel 10.

Figure 3:
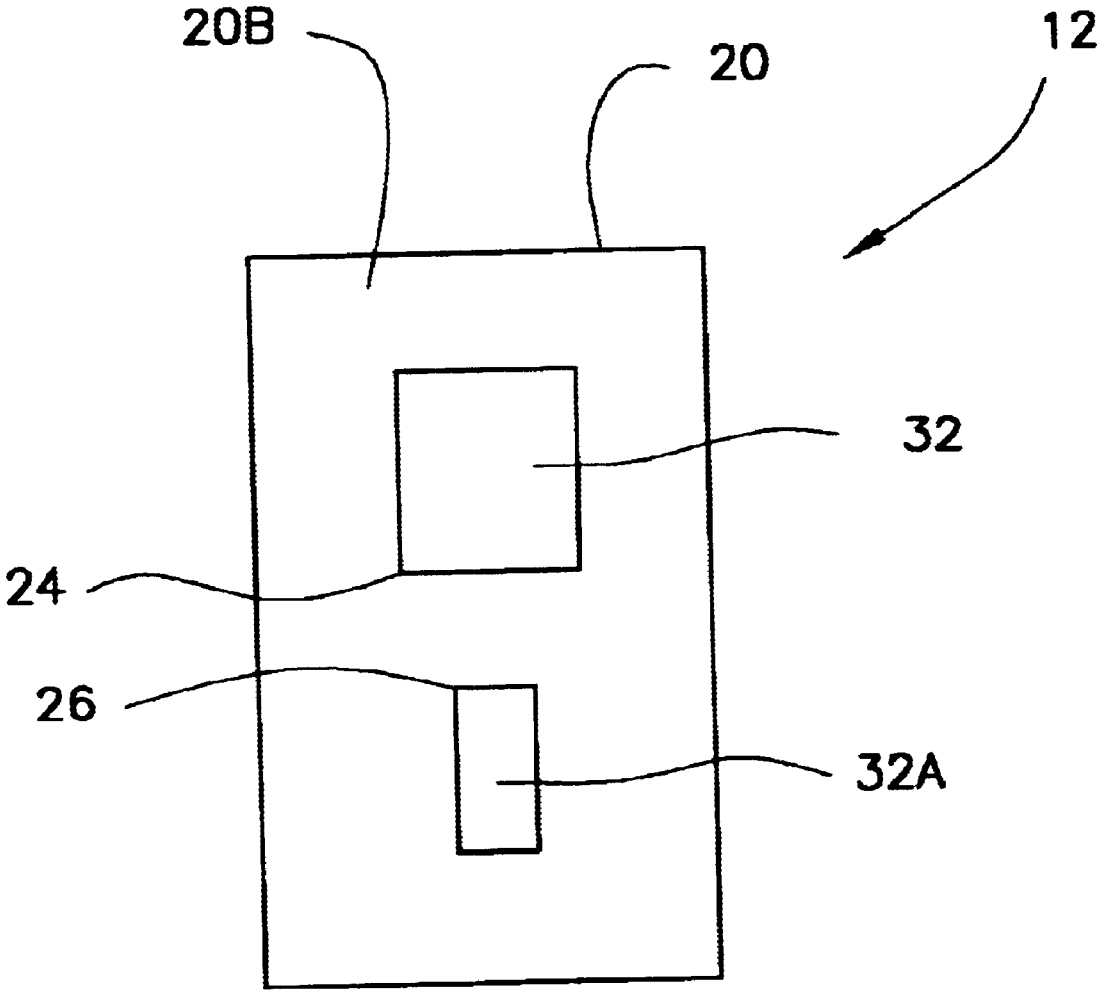
FIG. 3 is a rear view of a hanger display assembly of FIG. 1, in accordance with one embodiment of the present invention.

In one embodiment of the present invention, as illustrated in FIG. 3, upper arm 24 is thicker than lower arm 26. In order to save on manufacturing costs, less material can be used in lower arm 26, as its primary function is to stabilize the hanger display assembly 12. The major load bearing structure in hanger display assembly 12 is upper arm 24, and, as such, more of the material (polyurethane) can be used in upper arm 24. It should be noted that this in only intended to display one preferred embodiment of the present invention and is in no way intended to limit the scope of the present invention. Any size upper arm 24 and lower arm 26 which are capable of supporting a similar hanger display assembly 12 in a slot 14 of a display panel 10 are within the contemplation of the present invention.

In one embodiment of the present invention, as illustrated in FIGS. 1 and 2, upper and lower arms 24 and 26 are configured to be of particular width such that when hanger display assembly 12 is aligned in the same direction as slot 14 of display panel 10, both upper and lower arms 24 and 26 can fit through slot 14. When hanger display assembly 12 is rotated in a direction transverse to the direction of slot 14, upper and lower arms 24 and 26 of hanger display assembly 12 will not fit through slot 14, as clearly indicated in FIG. 2.

Thus, in operation a user first orients hanger display assembly 12 so as to align it with slot 14 on display panel 10, illustrated as assembly 12*a* in FIG. 1. The user then maneuvers upper and lower arms 24 and 26 of hanger display assembly 12 through slot 14 such that upper and lower arms 24 and 26 extend out through to the back surface 10*b* of display panel 10 and rear side 20*b* of base plate 20 abuts against front surface 10*a* of display panel 10. The user, while maintaining hanger display assembly 12 aligned in the same direction as slot 14, slides assembly 12 into the desired location.

After hanger display assembly 12 reaches the desired location, the user then rotates hanger display assembly 12 approximately 90 degrees such that hanger display assembly 12 is perpendicular to slot 14, illustrated as assembly 12*b* in FIG. 1. As illustrated in more detail in FIG. 2, after hanger display assembly 12 is rotated (hanger display assembly 12 in FIG. 2 correlates to the position of assembly 12*b* in FIG. 1), upper and lower arms 24 and 26 frictionally lock hanger display assembly 12 in place on display panel 10. Upper clip portion 34 and lower clip portion 34*a* are configured to rest firmly and frictionally engage back side 10*b* of display panel 10.

In one embodiment of the present invention, as illustrated in FIG. 2, the ends of upper clip portion 34 and lower clip portion 34*a*, distal to upper raised portion 32 and lower descending portion 32*a* respectively, form pressure points which directly abut against rear side 10*b* of display panel 10 as upper and lower arms 24 and 26 plastically deform, applying constant pressure against display panel 10. In this configuration, regardless of the shape of display panel 10, particularly back side 10*b*, hanger display assembly 12 is capable of being securely engaged in place, utilizing the pressure of upper and lower arms 24 and 26 caused by the plastic deformation as clip portions 34 and 34*a* abut against back side 10*b* of display panel 10.

As the pressure points located at the ends of upper clip portion 34 and lower clip portion 34*a*, distal to upper raised portion 32 and lower descending portion 32*a* respectively, engage rear side 10*b* of display panel 10, all of the portions of both upper and lower arms 24 and 26 are plastically deformed in such a way as to alter the position of upper extension portion 30 and lower extension portion 30*a* relative to one another. In the unconnected position (depicted as hanger display assembly 12*a* in FIG. 1) upper extension portion 30 and lower extension portion 30*a* are preferably substantially parallel to one another. However, in the connected configuration (depicted as hanger display assembly 12*b* in FIG. 1) after engagement of upper and lower clip portions 34 and 34*a* with display panel 10, the entire upper and lower arms 24 and 26 are plastically deformed such that upper and lower extension arms 30 and 30*a*, formerly parallel, are forced out of parallel alignment with one another, and the ends of upper and lower extension portions 30 and 30*a*, distal to said base plate are forced inward towards one another.

The rear side 20*b* of base plate 20 rests firmly against front side 10*a* of display panel 10 such that the combined force of base plate 20 and clip portions 34 and 34*a* hold hanger display assembly 12 in place on display panel 10. The user can then place merchandise on hanger element 18 as desired.

If a user so chooses, hanger display assembly 12 can be repositioned by simply unlocking hanger display assembly 12 by rotating it approximately 90 degrees (12*a*, FIG. 1) and sliding hanger display assembly 12 anywhere along slot 14 to the new location and then re-rotating approximately 90 degrees (12*b*, FIG. 1) in the new location.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A display assembly comprising:

a display panel having an elongated substantially horizontal extending slot therein, said display panel having a front side and a rear side;

a hanger display assembly having a base portion, said base portion having a first and second side, an engagement portion connected to said first side of said base portion, said engagement portion including first and second diverging arms protruding substantially perpendicular to said first side of said base portion, wherein said first diverging arm further comprises an upper extension portion extending perpendicularly away from said first side of said base plate, an upper raised portion extending perpendicularly away from said upper extension portion from an end distal to said base portion, and an upper clip portion which extends perpendicularly away from said upper raised portion from an end distal to said upper extension portion, in the same direction as said hanger element, and a hanger element extending outwardly from said second side of said base portion, said hanger element being substantially perpendicular to said base potion, said arms being receivable through said slot when they are substantially aligned therewith, but not when they are disposed in a substantially transverse relation to said slot, said arms being receivable for engagement with said rear side of said display panel when positioned substantially transverse to said slot so that said first side of said base portion directly abuts said front side of said display panel so that said hanger element extends outwardly beyond said front side of said display panel for receiving and supporting an item in front of said display panel.

2. The display assembly as claimed in claim 1, wherein said first and second sides of said base portion of said hanger display assembly are smoothly finished and run parallel to said front side of said display panel, such that when said hanger display assembly is positioned on display panel, said first side of said base plate rests smoothly against said front side of said display panel.

3. The display assembly as claimed in claim 2, where in said entire first side of said base plate rests against said front side of display panel.

4. The display assembly as claimed in claim 1, wherein said first and second diverging arms are independently formed from one another.

5. The display assembly as claimed in claim 1, wherein said first and second diverging arms are mounted on said first side of said base portion in the same axis as said hanger element.

6. The display assembly as claimed in claim 1, further comprising a hanger element support attached to said second side of said base portion and said hanger element, where said hanger element support attaches to said hanger element along a portion proximate said base portion.

7. The display assembly as claimed in claim 1, wherein said first diverging arm is larger than said second diverging arm.

8. The display assembly as claimed in claim 1, wherein said first and second arms are resiliently moveable together so as to facilitate movement into and out of said slot in said display panel.

9. The display assembly as claimed in claim 1, wherein said hanger element further comprises a raised portion positioned distal to said base plate configured to prevent merchandise displayed on said hanger display assembly from inadvertently falling off the end of said hanger element.

10. The display assembly as claimed in claim 1, wherein said hanger element extends 2.75" from said second side of said base plate.

11. The display assembly as claimed in claim 9, wherein said raised portion of said hanger element comprises 0.25" of said hanger element.

12. The display assembly as claimed in claim 1, wherein said first and second diverging arms extend for 0.5" from said first side of said base plate.

13. The display assembly as claimed in claim 1, wherein said base plate extends for 1.25" in the vertical direction, perpendicular to said hanger element.

14. The display assembly as claimed in claim 1, wherein said base plate extends for 0.75" in the horizontal direction, perpendicular to said hanger element.

15. A display assembly comprising:

a display panel having an elongated substantially horizontal extending slot therein, said display panel having a front side and a rear side;

a hanger display assembly having a base portion, said base portion having a first and second side, an engagement portion connected to said second side of said base portion, said engagement portion including first and second diverging arms protruding substantially perpendicular to said second side of said base portion, wherein said second diverging arm further comprises a lower extension portion extending perpendicularly away from said second side of said base plate, a lower descending portion extending perpendicularly away from said lower extension portion from an end distal to said base portion, and a lower clip portion which extends perpendicularly away from said lower descending portion from an end distal to said lower extension portion, in the same direction as said hanger element, and a hanger element extending outwardly from said second side of said base portion, said hanger element being substantially perpendicular to said base potion, said arms being receivable through said slot when they are substantially aligned therewith, but not when they are disposed in a substantially transverse relation to said slot, said arms being receivable for engagement with said rear side of said display panel when positioned substantially transverse to said slot so that said second side of said base portion directly abuts said front side of said display panel so that said hanger element extends outwardly beyond said front side of said display panel for receiving and supporting an item in front of said display panel.

16. The display assembly as claimed in claim 15, wherein said first and second sides of said base portion of said hanger display assembly are smoothly finished and run parallel to said front side of said display panel, such that when said hanger display assembly is positioned on display panel, said first side of said base plate rests smoothly against said front side of said display panel.

17. The display assembly as claimed in claim 16, where in said entire first side of said base plate rests against said front side of display panel.

* * * * *